United States Patent [19]

Koff

[11] 4,090,593

[45] May 23, 1978

[54] EXPANSIBLE CONTAINER

[76] Inventor: William Koff, 2100 S. Ocean La., Ft. Lauderdale, Fla. 33316

[21] Appl. No.: 829,293

[22] Filed: Aug. 31, 1977

[51] Int. Cl.[2] ..... A45C 7/00

[52] U.S. Cl. ..... 190/44; 150/30; 190/51; 190/52

[58] Field of Search ..... 190/43, 44, 51, 52, 190/21; 150/30

[56] References Cited

U.S. PATENT DOCUMENTS

| | | | |
|---|---|---|---|
| 3,122,225 | 2/1964 | Ward | 190/52 |
| 3,443,671 | 5/1969 | Dyke | 190/44 X |
| 3,830,348 | 8/1974 | Ohyama | 190/44 X |

*Primary Examiner*—Donald F. Norton
*Attorney, Agent, or Firm*—Ernest H. Schmidt

[57] ABSTRACT

An expansible container or bag has a pair of side panels and an inter-connecting, peripheral, relatively flexible gusset provided with a pair of slide fasteners, each extending from a position at the top outward to each end and down the ends to permit, selectively, either access to the interior of the bag when used in non-expanded configuration, or for turning the bag inside out for use thereof in expanded configuration. To this end, the insides of the side panels also form the inside panels of a pair of zippered auxiliary bag compartments, normally contained within the bag but which, when the bag is turned inside out, expand outwardly of each side of the bag to substantially triple holding capacity.

14 Claims, 7 Drawing Figures

EXPANSIBLE CONTAINER

My invention is directed generally to carrying cases, containers or bags, and is directed particularly to improvements in carrying containers whereby they may be converted from one configuration and size for having a first given holding capacity to a second configuration having a substantially increased holding capacity within a range of two, three and even four times the first configuration capacity.

Various types of luggage, carrying cases, handbags and the like have heretofore been devised with extra compartments of one kind or another that are foldable or receivable within the main compartment for selectively enlarging holding capacity. Such convertible or expansible carrying cases, containers or bags heretofore known have found only limited acceptance in the industry for various reasons, principally because they are of complicated and expensive construction, limited in degree of expansion, or because they are unattractive when expanded. It is, accordingly, the principal object of this invention to provide a novel and improved expansible container that obviates the deficiencies of previous designs.

Another object of my invention is to provide an expansible carrying case or handbag construction of the character described which is well suited to the manufacture of a wide variety of cases or containers including but not necessarily limited to, handbags or pocketbooks, clutch bags, vanity cases, toiletry cases, billfolds, attache cases, shipping containers, valises and the like luggage. Still another object of the invention is to provide an expansible case of the above nature which can readily be fabricated of a wide variety of attractive and durable fabrics and materials, and wherein the manufacturing process is simple and straightforward.

Yet another object of my invention is to provide an expansible case, bag or the like of the character described which will be attractive in appearance in either configuration, and which will be easy to convert, inexpensive to manufacture, and durable and efficient in use.

Other objects, features and advantages of the invention will be apparent from the following description when read with reference to the accompanying drawings. In the drawings, wherein like reference numerals denote corresponding parts throughout the several views.

Figure 1:
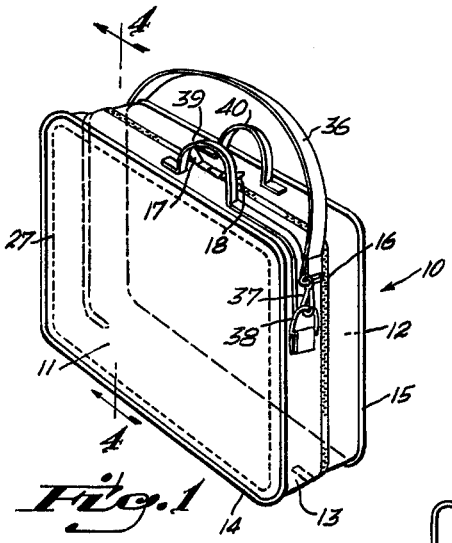
FIG. 1 is a perspective view, as seen from above, of a preferred form of expansible bag embodying the invention.
Figure 3:
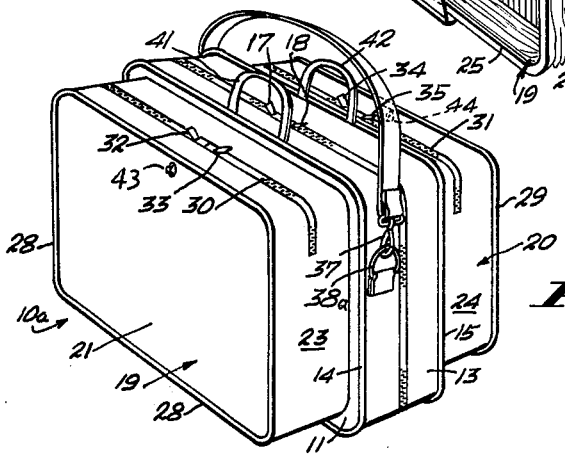
FIG. 3 is a perspective view as seen from above and illustrating its conversion to expanded configuration.
Figure 4:
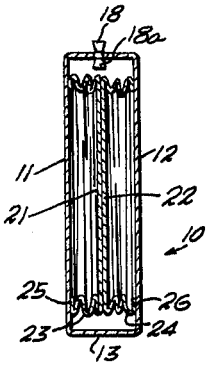
FIG. 4 is a vertical cross-sectional view taken along the plane indicated at 4—4 of FIG. 1 in the direction of the arrows and further illustrating constructional details of the invention.

Referring now in detail to the drawings, reference numerals 10 and **10*a* designate, generally, a preferred form of expansible container embodying my invention, shown in non-expanded and expanded configuration respectively, in FIGS. 1 and 3. As is best illustrated in FIGS. 1 and 4, the expansible bag comprises opposed main compartment side panels 11, 12, which may be substantially rectangular in shape, and which are peripherally interconnected by a pliable gusset 13. While the side panels 11, 12, may also be fabricated of a pliable fabric, canvas, synthetic plastic material, leather or simulated leather, for example, they could as well be rigid, it only being necessary that the gusset 13 have the degree of flexibility required to perform the conversion process from the non-expanded configuration of FIG. 1 to the expanded configuration of FIG. 3, as is hereinafter more particularly described. For a finished appearance the outer edges of the side panels, 11, 12 will be bound where they join the gusset 13, as indicated at 14 and 15, respectively. To provide for access to the main compartment defined by side panels, 11, 12, and gusset 13, said gusset has a central slide fastener or zipper 16 extending along the top and down the ends thereof to terminate at or slightly beyond the bottom edge of the container to facilitate turning the main compartment inside out in a manner and for the purpose hereinafter more particularly described. The zipper 16 is controlled for opening and closing by a pair of reversible zipper slide operators or tabs 17, 17*a* and 18, 18*a***, which will normally close at a top central portion of the container, as illustrated.

Figure 2:
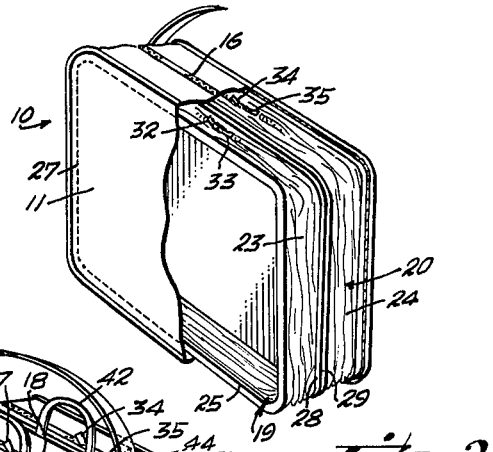
FIG. 2 is a perspective view as in FIG. 1, but with portions broken away to illustrate interior construction and details.

The expansible container 10 or **10*a* also comprises auxiliary compartments 19, 20, normally contained within the above-described main compartment (see FIG. 2). The auxiliary compartments 19, 20, comprise outer side panels 21, 22, respectively, (see FIG. 4), secured in normally parallel relation with respect to inner walls 11, 12, of the main compartment by peripheral interconnecting gussets 23, 24, respectively. As best illustrated in FIGS. 2 and 4, the auxiliary container gussets 23, 24, may be formed with respective in-turned flange portions 25, 26, respectively, whereby they can be secured, as by stitching 27, to the insides of main container side panels 11 and 12, respectively. It will thus be apparent that the main compartment side panels 11 and 12 also comprise the inner side walls or panels of respective auxiliary compartments 19 and 20. For a finished appearance, the outer edges of the auxiliary compartment outer side panels 21, 22 will be bound or piped where they join their respective gussets 23, 24, as indicated at 28 and 29, respectively (see FIGS. 2, 3 and 7**).

Figure 7:
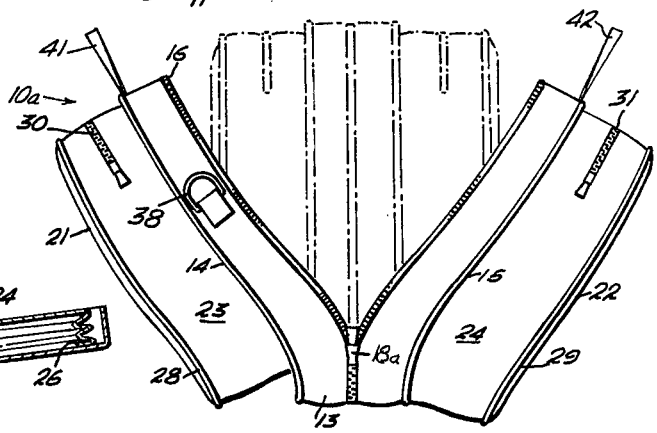
FIG. 7 is an end view of the expansible handbag illustrating the final step in its conversion from the non-expanded configuration as illustrated in FIG. 1 to the expanded configuration as illustrated in FIG. 3.

As is best illustrated in FIGS. 2, 3 and 7, to provide for access to the auxiliary compartments 19, 20, their gussets 23, 24 have respective central slide fasteners or zippers 30, 31, each extending along the top and partly down the ends thereof. Each of the zippers 30, 31 is provided with zipper slide operators or tabs 32, 33, and 34, 35, respectively, which may close anywhere along the length of the zipper, but which will normally close at the top central portion of the container as illustrated.

To provide for carrying the container 10 or **10*a* as a shoulder bag, a shoulder strap 36, which will preferably be of adjustable length, has snap hooks 37 at each end (only one end illustrated in FIGS. 1 and 3) adapted to be removably attached to D-rings 38 at opposite ends of the bag 10 when in compacted configuration as illustrated in FIG. 1, or to D-rings 38*a* (only one illustrated in FIG. 3) when the bag is converted to expanded configuration as illustrated in FIG. 3. In each instance the D-ring pairs 38, 38, or 38*a*, 38*a*, are secured to opposite side portions of the main compartment gusset 13, so that the strap 36 will extend centrally over the main compartment zipper 16 for balanced weight distribution when carrying the bag by means of said shoulder strap, irrespective of whether the handbag is in the non-expanded configuration of FIG. 1 or the expanded configuration of FIG. 3**.

To provide for carrying of the expansible handbag as one would an ordinary pocketbook or valise, a pair of flexible hand grip loops 39, 40, are affixed at a central position along the main compartment gusset 13 at each side of the central zipper 16. It will be understood that in use, both of the hand grip loops 39, 40 will be gripped together, being flexible enough for this purpose, for balanced suspension when carrying the bag in its non-expanded configuration.

As illustrated in FIGS. 3 and 7, hand grip loops 41 and 42 are also provided for hand carrying of the expansible bag when in expanded configuration. The hand grip loops 41, 42, are sewn or otherwise attached along the respective junctures of main container side panels 11 and 12 with peripheral gusset 13, and normally, when bag is in the non-expanded configuration of FIG. 1 are contained within the main container. By the same token, when the bag is in the expanded configuration, as illustrated in FIG. 3, the hand grip loops 39, 40, will be contained within the main or central compartment.

Figure 5:
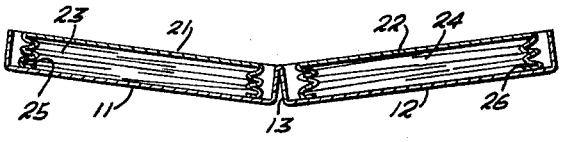
FIG. 5 is a vertical cross-sectional view as in FIG. 4 and illustrating the beginning step in coverting the bag from non-expanded to expanded configuration.
Figure 6:
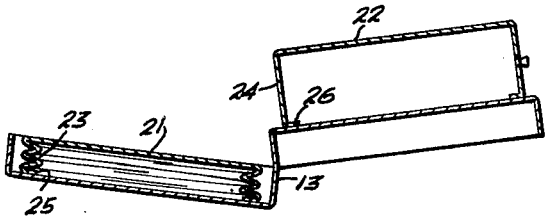
FIG. 6 illustrates the next successive step in converting the bag to expanded configuration.

Referring now to the schematic illustrations of FIGS. 4, 5 and 6 in considering the conversion of the expansible bag from its non-expanded configuration of FIG. 1 to the expanded configuration of FIG. 3, it is to be understood that the main bag compartment zipper 16 will be fully opened by sliding zipper operator tabs 17 and 18 in opposite directions fully down the ends of gusset 13, whereupon, as illustrated in FIG. 5, main compartment side panels 11 and 12 can unfold outwardly along a central bottom portion of interconnecting gusset 13, so that they define an obtuse angle. Thereafter, as illustrated in FIG. 6, each of such separated halves of the gusset 13 will be pushed or otherwise manipulated inside out, whereupon the auxiliary compartments defined by outer auxiliary side panels 21, 22 and their respective gussets 23, 24 will be converted for extension from the outside of the main compartment when the bag is in expanded configuration. FIG. 6 also illustrates, by way of example, how this conversion is made at one side of the thus opened extensible bag. The remaining half will next be pushed or otherwise manipulated inside out, whereupon, as illustrated in FIG. 7, the two halves of the main compartment gusset 13 can be brought together in inside-out relative relation to complete the conversion to expanded configuration as illustrated by the broken-line representation thereof, by closing the main gusset 13 with use of inside zipper operating tabs of zipper 16 (only inner zipper operator tab **18*a* illustrated in FIGS. 4 and 7). Since the main compartment gusset 13 and the gussets 23 and 24 of the auxiliary compartments 21 and 22** may be of substantially the same width, it will be understood that conversion of the handbag from non-expanded configuration to expanded configuration as described above will almost triple the holding capacity of the bag.

In use of the expansible bag when in the non-expanded configuration of FIG. 1, it will be understood that sliding of the zipper operating tabs 17 and 18 to each end of the main compartment gusset 13 will permit access to the main compartment, as well as access to the interior auxiliary compartments 19 and 20. Thus, either the main compartment can be used by itself, simply by compacting the auxiliary compartments to their respective insides of main compartment side panels 11 and 12, or said auxiliary compartments can be used as separate containers, opened as required by their respective zipper operating tabs 32, 33 and 34, 35, or in combination with space within the main container and outside of auxiliary containers 19 and 20. In this connection it will further be understood that the auxiliary gussets 23, 24, will be pliable and compactable enough to accommodate themselves to the reduced dimensions imposed by the main container gusset 13. To facilitate access to compartments 23 and 24 when the bag is in non-expandable configuration, male and female snap fasteners 43, 44 are provided for releasably interconnecting top central portions of the outer side panels 21, 22 of said auxiliary compartments, thus assuring better positioning and easier access thereto.

While I have illustrated and described my invention as applied to the construction of luggage or a handbag type containers, it is to be understood that this embodiment is presented by way of example only, and that the invention can be applied as well to expansible clutch bags, vanity bags, attache cases, billfolds, toiletry kits and the like wherein expansibility for various carrying purposes is required or desired. It is therefore to be understood that the invention is to be limited only by the scope and spirit of the following claims:

What I claim as new and desire to secure by Letters Patent is:

1. An expansible container comprising, in combination, a first compartment having a pair of opposed first side panels and a peripheral interconnecting first gusset, means for opening said first gusset along the top thereof to gain access to the interior of said first compartment, a second compartment normally disposed within said first compartment and having an auxiliary side panel opposed to one of said first compartment side panels and a peripheral second gusset interconnecting said auxiliary side panel and said one of said first compartment side panels, and means for opening said second gusset along the top thereof to gain access to the interior of said second compartment, said first gusset being flexible enough to permit the turning of said first compartment inside out upon the opening of said first gusset opening means, whereby said second compartment will extend outwardly of one side of said first compartment for conversion of the container assembly from unexpanded configuration to expanded configuration.

2. An expansible container as defined in claim 1 and further including a third compartment normally disposed within said first compartment and having a second auxiliary side panel opposed to the other of said first compartment side panels and a peripheral third gusset interconnecting said second auxiliary side panel and said second of said first compartment side panels, and means for opening said third gusset along the top thereof to gain access to the interior of said third compartment, whereby, upon turning said first compartment inside out after the opening of said first gusset opening means said second and third compartments will expand outwardly of one side each of said first compartment for conversion of the container assembly from unexpanded configuration to expanded configuration.

3. An expansible container as defined in claim 1 wherein said first gusset opening means extends along the ends as well as along the top of said first gusset to facilitate turning said first compartment inside out.

4. An expansible container as defined in claim 3 wherein said first gusset opening means comprises a zipper having an operator with inner and outer operating tabs.

5. An expansible container as defined in claim 3 wherein said first gusset opening means comprises a zipper having a pair of operators, each of which has inner and outer operating tabs manually controllable to open said first gusset from a top position therealong to and down each end of said first gusset.

6. An expansible container as defined in claim 5 wherein said first side panels are comparatively rigid with respect to said gussets.

7. An expansible container as defined in claim 6 wherein said auxiliary side panels are comparatively rigid with respect to said gussets.

8. An expansible container as defined in claim 2 wherein said first gusset opening means extends along the ends as well as along the top of said first gusset to facilitate turning said first compartment inside out.

9. An expansible container as defined in claim 8 wherein said first gusset opening means comprises a zipper having inner and outer operating tabs.

10. An expansible container as defined in claim 9 wherein said second and third gusset opening means each comprises a zipper having a pair of operators normally controllable to open said second and thid gussets from any position therealong.

11. An expansible container as defined in claim 10 wherein said first side panels are comparatively rigid with respect to said gussets.

12. An expansible container as defined in claim 11 wherein said auxiliary side panels are comparatively rigid with respect to said gussets.

13. An expansible container as defined in claim 2 including means for releasably interconnecting said first and second auxiliary side panels when contained within said first compartment.

14. An expansible container as defined in claim 2 including a shoulder strap and means for releasably attaching the ends of said shoulder strap to outer end portions of said first gusset, either when the container assembly is in unexpanded or expanded configuration, selectively.

* * * * *